United States Patent [19]

Marrero

[11] 4,246,629

[45] Jan. 20, 1981

[54] FLUORESCENT LIGHT FIXTURE

[76] Inventor: Louis Marrero, 1209 Via Ramon, Escondido, Calif. 92025

[21] Appl. No.: 84,836

[22] Filed: Oct. 15, 1979

[51] Int. Cl.[3] ..... F21S 1/02

[52] U.S. Cl. ..... 362/147; 362/151; 362/225; 362/260; 362/370; 362/432

[58] Field of Search ..... 362/147, 151, 217, 225, 362/260, 370, 432

[56] References Cited

U.S. PATENT DOCUMENTS

| | | | |
|---|---|---|---|
| 2,290,301 | 7/1942 | Stair | 362/225 |
| 2,418,926 | 4/1947 | Francis | 362/370 |
| 3,329,811 | 7/1967 | Schiffer | 362/225 |

FOREIGN PATENT DOCUMENTS

| | | | |
|---|---|---|---|
| 1096496 | 1/1961 | Fed. Rep. of Germany | 362/432 |
| 1540702 | 10/1967 | France | 362/432 |
| 1147969 | 4/1969 | United Kingdom | 362/147 |

*Primary Examiner*—Donald P. Walsh

[57] ABSTRACT

A fluorescent light fixture is provided which can be easily assembled from kit form and in essence provides a reversible mounting system such that the main housing can be alternatively mounted flush against a flat wall or ceiling surface or reversed so that a pair of orthogonally related housing walls fit flush into a corner defined between two walls or a wall and a ceiling. The flat wall mode of deployment can also be adapted to be spaced from a ceiling by the addition of a pair of conventional chain mounts used for fluorescent fixtures.

8 Claims, 7 Drawing Figures

FLUORESCENT LIGHT FIXTURE

BACKGROUND OF THE INVENTION

With the soaring costs of energy has come a high level of interest in the maximized efficiency of the use of energy. When it comes to providing light, it is a well-known fact that fluorescent fixtures utilize electrical energy a great deal more efficiently than do incandescent fixtures.

However, one drawback of the fluorescent fixture typically is the relative difficulty of installation because the fixtures involve a long housing, ordinarily 4' in length or greater, and is in general much more complicated than a simple incandescent light fixture, which is very elementary to mount.

In the wake of the energy problem has come a nationally marketed fluorescent fixture which is circular with a self-contained ballast transformer which screws into a conventional incandescent light socket. These are somewhat expensive however, and are somewhat limited in their lumen output due to weight and tube length considerations.

There is therefore a need for a simple fluorescent which is easily installed by non-technical people and which can be mounted alternatively at the election of the user in any of the ordinary modes of deployment of fluorescent lights, which are flush against the ceiling, flush against a wall, flush into a corner defined by two walls or a wall and a celling, or suspended from the ceiling.

SUMMARY OF THE INVENTION

The present invention fulfills the above-mentioned need and utilizes as one of its basic elements an elongated housing which accepts mounting brackets conforming to its exterior surface, both mounting brackets and housing defining on one side a flat plane suitable for mounting against a planar wall or ceiling surface, and on the other side defining a pair of orthogonally related plates to permit mounting of the housing in this reverse direction into a corner.

The housing has alternative fluorescent socket mounting positions at the two ends of the housing so that a conventional fluorescent light transformer ballast can be inserted within the housing and the sockets connected thereto mounted alternatively in the appropriate socket mount positions corresponding to flat mount or corner mount applications.

At each end of the housing is a snap-in retainer plate which doubles as a retainer for maintaining the tube sockets in position and also mounts an end cap, the pair of which together retain a planar translucent lens to finish off the appearance of the light. The end caps and lenses are provided in alternative sets to accommodate corner mounts and flat wall or ceiling mounts, and the above-mentioned mounting brackets are so structured as to alternatively accept a pair of suspension chains so that the fixture may be suspended from a ceiling rather than flush mounted against the ceiling or wall.

DETAILED DESCRIPTION OF THE PREFERRED EMBODIMENT

Figure 4:
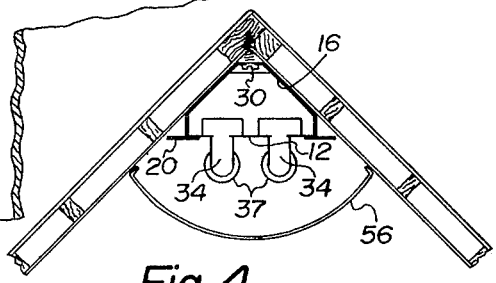
FIG. 4 is a vertical section detailing the corner mounting mode.

The basic rigidity of the fixture is provided by the elongated sheet metal housing 10. The housing includes one broad, flat wall 12 and a pair of orthogonally related walls 14 on the other side of the housing from the flat wall 12. This is important to the invention as the reversal of the housing will enable it to fit snugly either against a flat wall as shown in FIG. 7 or into a corner between two walls or a wall and a ceiling as shown in FIG. 4.

To mount the housing in a corner or against a flat wall, a pair of brackets 16 are used which conform substantially to the contours of the orthogonal walls 14, intermediary connecting walls 18, and overlap the flat wall 12 slightly with mounting feet 20. There are two slight modifications of the form of this bracket, bracket 16 as shown in FIG. 1 being indicative of the result of an extrusion process and bracket 22 in FIG. 7 representing a typical sheet metal stamping which could be used as an alternative.

Both brackets have a central mounting hole 24 and a pair of lateral mounting holes 26 which in case of embodiment 22 are each by necessity duplicated as shown.

Figures 1, 2:
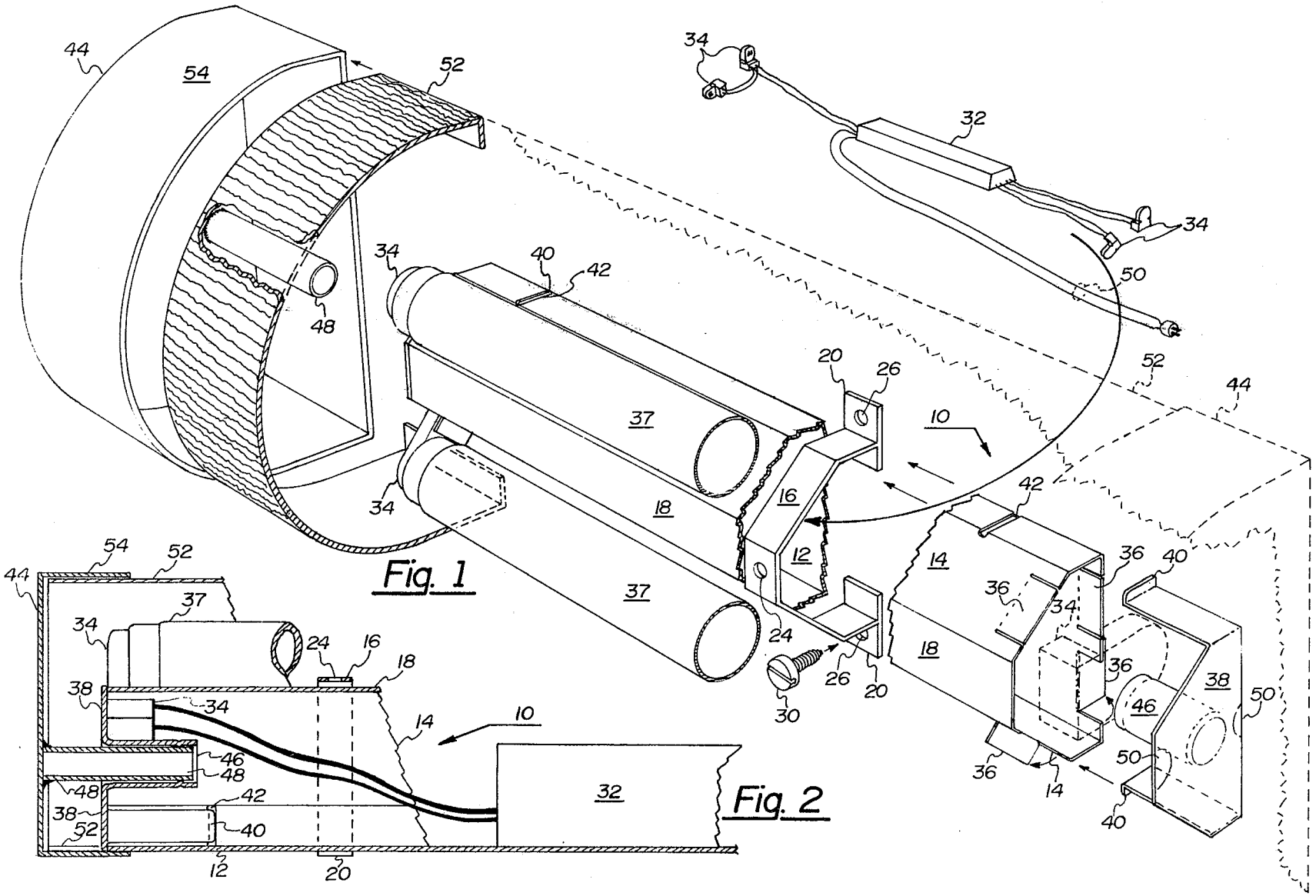
FIG. 1 is an exploded perspective view of the fixture with portions cut away.
FIG. 2 is a section through one end of the fixture.
Figure 3:
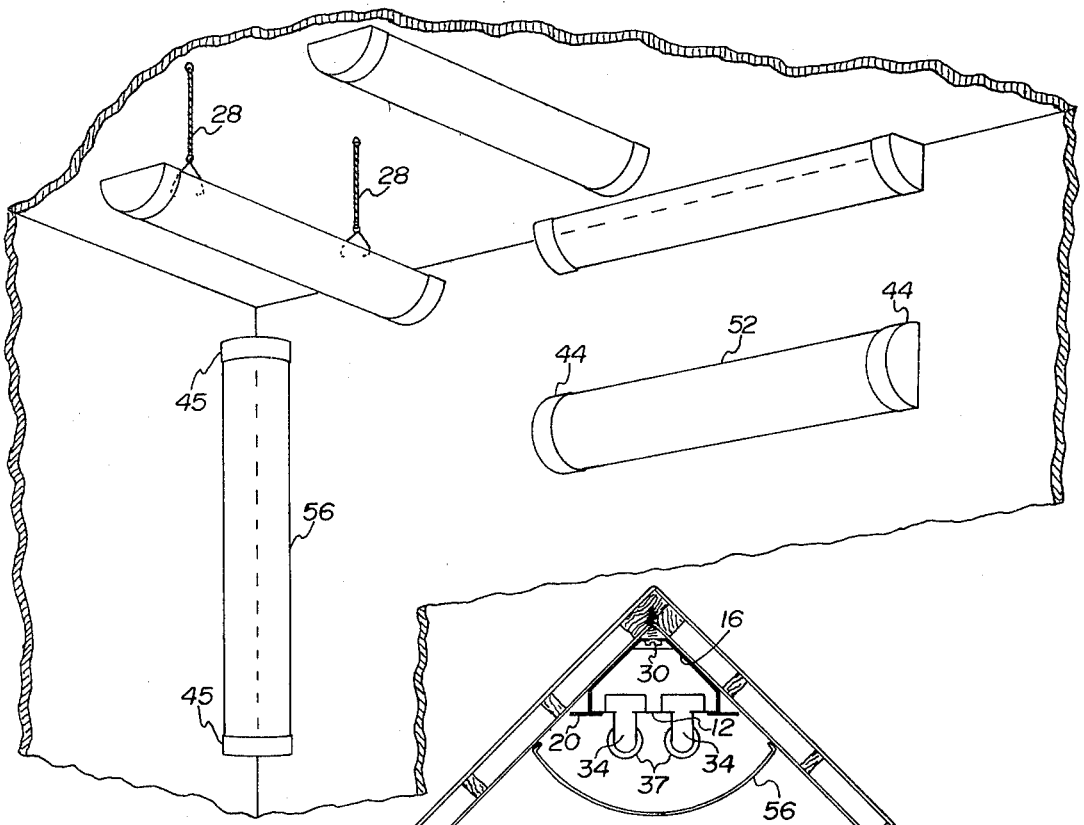
FIG. 3 illustrates the five different mounting modes of the fixture.
Figure 7:
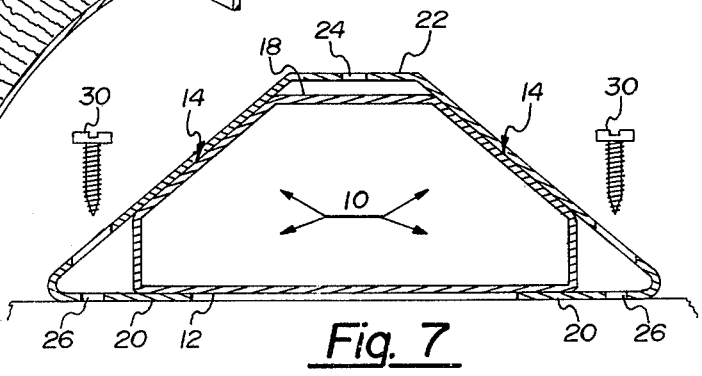
FIG. 7 is a sectional view of the housing and a modified form of the mounting bracket illustrating the flat wall mount.

When the fixture is used to mount against a flat wall or ceiling, the housing is engaged by the brackets and screwed to the wall through lateral holes 26 as indicated in FIGS. 1 and 7. These holes can also be used if the fixture is to be suspended by chains 28 as shown in FIG. 3. Because the brackets slide freely along the housing until mounted, they can be positioned to correspond with a pair of studs in either the flat or corner mount.

In the event the housing is corner mounted, the brackets can first be installed by a nail or a single screw 30 shown in FIG. 4 with the housing subsequently being slid longitudinally into the brackets or the lateral holes 26 can be used by putting the screws in the reverse of the direction shown in FIGS. 1 and 7. The latter technique is advantageous in that it permits the brackets to be installed around the housing prior to their mounting, although the single screw technique, aside from halving the number of screws required, also guarantees the engagement of a screw into the stud inasmuch as corners are always backed by wooden studs.

Figure 5:
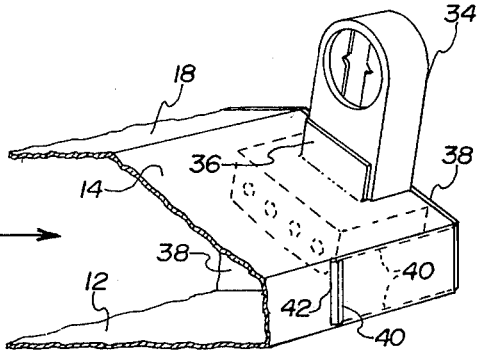
FIG. 5 is a perspective of a detail of the fixture showing the socket mount.
Figure 6:
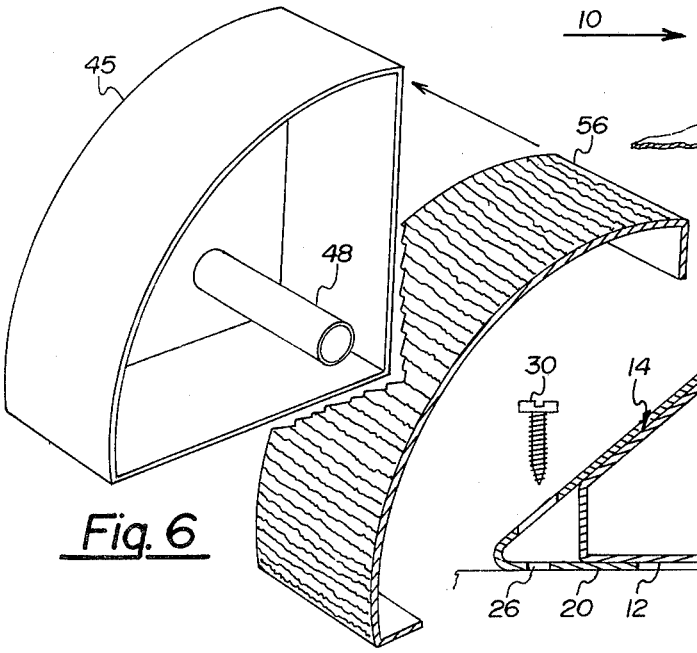
FIG. 6 is an exploded perspective detail showing the lens and end cap accommodation.

The housing 10 is dimensioned to accept a standard transformer/ballast package 32 and is dimensioned to frictionally retain this package as it is slid in from either end of the housing. When the transformer is in place the sockets 34 which comprise part of the transformer package can be mounted alternatively as the ends of the orthogonal walls 14 or the ends of the flat wall 12 by virtue of the knock-outs 36. These knock-outs could of course be omitted and left as gaps if desired. In either event, the sockets 34 have mounting grooves which enable them to slide into place snugly as shown in FIG. 5 properly spaced to mount a fluorescent tube 37 and without any further mounting structure except for retainers 38, which are sheet metal pieces having springloaded detents 40 which snap into place in keyways 42 and double as retainers for the sockets 34 and end caps 44 or 45, as desired. The retainers each define an inwardly directed socket 46 which is resiliently yielding formed by a split cylinder, or the like, and each socket receives in retaining mated relation the plug 48 of the end cap. This relation is best seen in FIG. 2. There are also a pair of knock-outs 50 on the retainers to accommodate the power cord to the ballast package.

End caps 44 as seen in FIG. 1 are clearly generally semi-circular in cross section and are used when the fixture is mounted against a flat wall to cover the otherwise exposed areas of the florescent tubes. Before these end caps are snaped into place in the retainers 38, a semi-circular elongated lens 52 is captured between the two arcuate walls 54 defined by the end caps.

The alternatively selectable end caps 45 are, of course, used the same way as are the end caps 44 but in a corner mount, and come with a compatible lens 56 which defines a quadrant rather than a semi-circle.

Thus as can be seen from FIG. 3, the unit is easily mountable vertically, horizontally, in a corner, against a flat wall, or suspended from the ceiling. It could be modified to provide a single fluorescent tube, or perhaps more than two, and otherwise accommodates virtually every conceivable need or application for fluorescent lighting, and should be instrumental in accelerating the installation of the alternative fluorescent light means to the end of reducing the utility bill of the user and player some small part in the reduction of the nation's dependency on any energy source.

What is claimed is:

1. A fluorescent light fixture comprising:

(a) an elongated housing dimensioned to house a fluorescent transformer/ballast and having socket mounts in each end thereof mounting at least one fluorescent tube socket, said sockets being wired to said transformer/ballast;

(b) at least two brackets for engaging said housing in spaced positions therealong, one side of each bracket defining a flat plane for wall mounting and the other side defining a pair of orthogonal planes for corner mounting;

(c) two end caps and means retaining same at respective ends of said housing; and (d) an elongated planar lens spanning the length of said housing and being engaged by said end caps to cover the otherwise exposed area of a fluorescent tube plugged into said sockets.

2. The structure according to claim 1 wherein said housing is polygonal in cross section defining one flat wall on one side and two orthogonally related walls on the other side, and said brackets each comprise a rigid strap conforming in shape to said orthogonal walls and overlapping at least partially onto said flat wall.

3. The structure according to claim 1 wherein the ends of each of said walls define at least one socket mount, whereby fluorescent tubes can be mounted along said orthogonal walls when said fixture is mounted against a flat surface, and at least one fluorescent tube can be mounted along said flat wall when said fixture is corner-mounted.

4. The structure according to claim 3 wherein said socket mounts comprise knock-outs into which sockets are slidably engaged, and said means for mounting said end caps comprises a pair of retainers engaged in the ends of said housing retaining one or more sockets in the respective knock-outs.

5. The structure according to claim 1 wherein two pairs of end caps and two lenses are provided, one pair and one lens being shaped substantially semi-circularly in cross section to accommodate a wall-mounted fixture and the other pair and lens substantially defining a quadrant in cross section to accommodate an alternative corner-mounted fixture.

6. The structure according to claim 1 wherein said means retaining said end caps comprises a pair of retainers having detents cooperating with structure on said housing permitting said retainers to be snapped into place.

7. The structure according to claim 6 wherein said retainers each define an inwardly directed retainer socket and said end caps each define a plug engageable in said socket.

8. Structure according to claim 1 wherein said brackets are independent of said housing and slideable therealong to permit repairing same compatibly with wall stud spacing.

* * * * *